United States Patent [19]

Dutzler

[11] 3,983,925

[45] Oct. 5, 1976

[54] APPARATUS FOR COOLING A CONTINUOUSLY CAST STRAND

[75] Inventor: Wilhelm Dutzler, Linz, Austria

[73] Assignee: Vereinigte Osterreichische Eisen- und Stahlwerke-Alpine Montan Aktiengesellschaft, Linz, Austria

[22] Filed: Dec. 17, 1974

[21] Appl. No.: 533,614

[30] Foreign Application Priority Data

Dec. 18, 1973 Austria ..... 10548/73

[52] U.S. Cl. ..... 164/283 S; 118/DIG. 23

[51] Int. Cl.[2] ..... B22D 11/12

[58] Field of Search ..... 164/89, 283 S, 283 R; 118/69, 637, DIG. 23

[56] References Cited

UNITED STATES PATENTS

| | | | |
|---|---|---|---|
| 3,766,968 | 10/1973 | Fortner et al. | 164/283 S |
| 3,783,827 | 1/1974 | Fukushima et al. | 118/DIG. 23 |

FOREIGN PATENTS OR APPLICATIONS

| | | | |
|---|---|---|---|
| 1,476,702 | 3/1967 | France | 164/283 R |

*Primary Examiner*—Robert D. Baldwin

*Attorney, Agent, or Firm*—Brumbaugh, Graves, Donohue & Raymond

[57] ABSTRACT

A method of cooling continuously cast strands in the tertiary cooling zone of continuous casting plants, so as to achieve a more regular cooling, has the cooling water fall onto the machine parts in the form of a finely distributed spray. Surplus cooling water in the area of the uncovered spaces between the machine parts is drained off by collecting devices. Thus the cooling water is prevented from directly hitting the hot strand surface. Moreover, a continuous casting plant for carrying out the above described method comprises an upper and a lower guiding-roller path and cooling water spray nozzles arranged above the upper guiding-roller path over the entire width of the strand. Above the rollers in the area of the uncovered spaces, channels are arranged running transversely in relation to the casting direction of the strand and having lateral outlets.

4 Claims, 4 Drawing Figures

APPARATUS FOR COOLING A CONTINUOUSLY CAST STRAND

BACKGROUND OF THE INVENTION

The invention relates to a method of cooling continuously cast strands, in particular slabs, in the tertiary cooling zone of continuous casting plants in which the strand is bent from the vertical into the horizontal and cooling water is supplied from above onto the guiding, supporting and transporting rollers.

In continuous casting of strands the metal to be cast is first cooled in the mold. At this primary cooling a thin skin of solidified metal is formed. The strand, which is withdrawn from the mold and bent in an arc, is further cooled in the secondary cooling zone by direct spraying with water under pressure supplied from nozzle systems. Finally the strand is bent into the horizontal, whereupon a further, less intensive, cooling is necessary. In this tertiary cooling zone of known plants only the machine parts themselves are cooled, i.e. hollow guiding and transporting rollers that contact the strand are flown through by cooling water. Also other machine parts, such as the crossheads of the roller paths, may be hollow and flown through by cooling water. On account of using hollow machine parts this kind of cooling is, however, complicated and expensive; the cooling effect is relatively low and keeps deteriorating because of scale deposits and the like. Moreover, thermal stress occurs in the machine parts, which may lead to distortions.

It is also known to make water fall in the form of a spray directly from above onto the machine parts in the tertiary cooling zone in the horizontal part; however, there is the difficulty that the rollers and the cross beams on which the rollers are borne do not cover the strand surface completely. The spaces between the rollers arranged to follow one after the other in the casting direction and further spaces between individual parts of a roller in the case of rollers consisting of several parts remain uncovered. Through these spaces the cooling water that is supplied penetrates like a torrent onto the strand surface. The consequence thereof is an extremely irregular, scanned cooling of the strand surface itself besides the cooling of the machine parts. This causes tensions and impairs the optimum skin growth.

SUMMARY OF THE INVENTION

The invention aims at avoiding the above mentioned disadvantages and difficulties and it is its object to make the cooling in the tertiary cooling zone of a continuous casting plant more regular by preventing at least to the largest possible extent, surplus cooling water from falling directly onto the strand surface. This is achieved by having the cooling water fall onto the machine parts in a finely distributed spray and by having the surplus cooling water in the area of the uncovered spaces between the machine parts drained off to a large extent by means of collecting devices so as to prevent the cooling water from directly hitting the hot strand surface.

The invention further comprises a device with a tertiary cooling zone in the horizontal part. The tertiary cooling zone is provided with a lower and an upper guiding-roller path for guiding, supporting and transporting the strand. The rollers are comprised of one component or of several components and the cooling water spray nozzles are arranged above the upper guiding-roller path over the entire width of the strand. According to the invention the device is characterized in that, at certain distances above the rollers in the area of the uncovered spaces between the machine parts, channels having lateral outlets are arranged transversely in relation to the casting direction of the strand.

Preferably, above each space between the rollers, which are arranged to follow one another, one collecting channel is arranged.

According to a preferred embodiment with rollers comprised of several components, additional channels running in the casting direction of the strand are arranged. These channels form a network with the channels running in the transverse direction because the transverse channels and the longitudinal channels are interconnected at their points of intersection.

A constructionally approved device has the rollers of the upper guiding-roller path secured to longitudinal carriers that are provided with two crosspieces and a base plate, whereby longitudinal channels are formed. The transverse channels are secured to the bearing construction of the rollers.

In addition narrow longitudinal channels may be arranged at either side of each longitudinal carrier and supported by the transverse channels.

BRIEF DESCRIPTION OF THE DRAWINGS

In order that the invention may be more fully understood two embodiments thereof will now be described in more detail by way of example with reference to the accompanying drawings in which.

DESCRIPTION OF EXEMPLARY EMBODIMENTS

Figure 1:
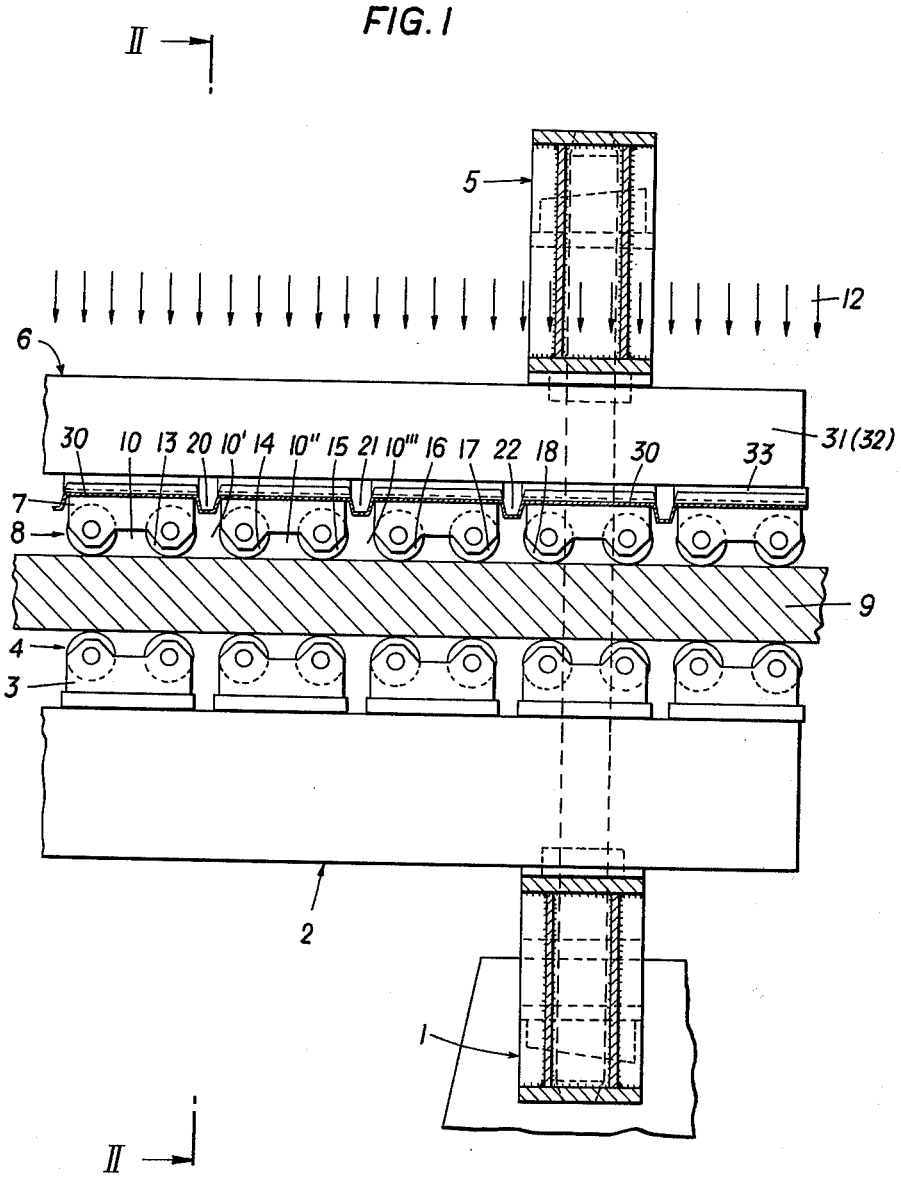
FIG. 1 shows a sectional elevation through the guiding path of an arc-shaped continuous casting plant after the strand has been bent into the horizontal.
Figure 2:
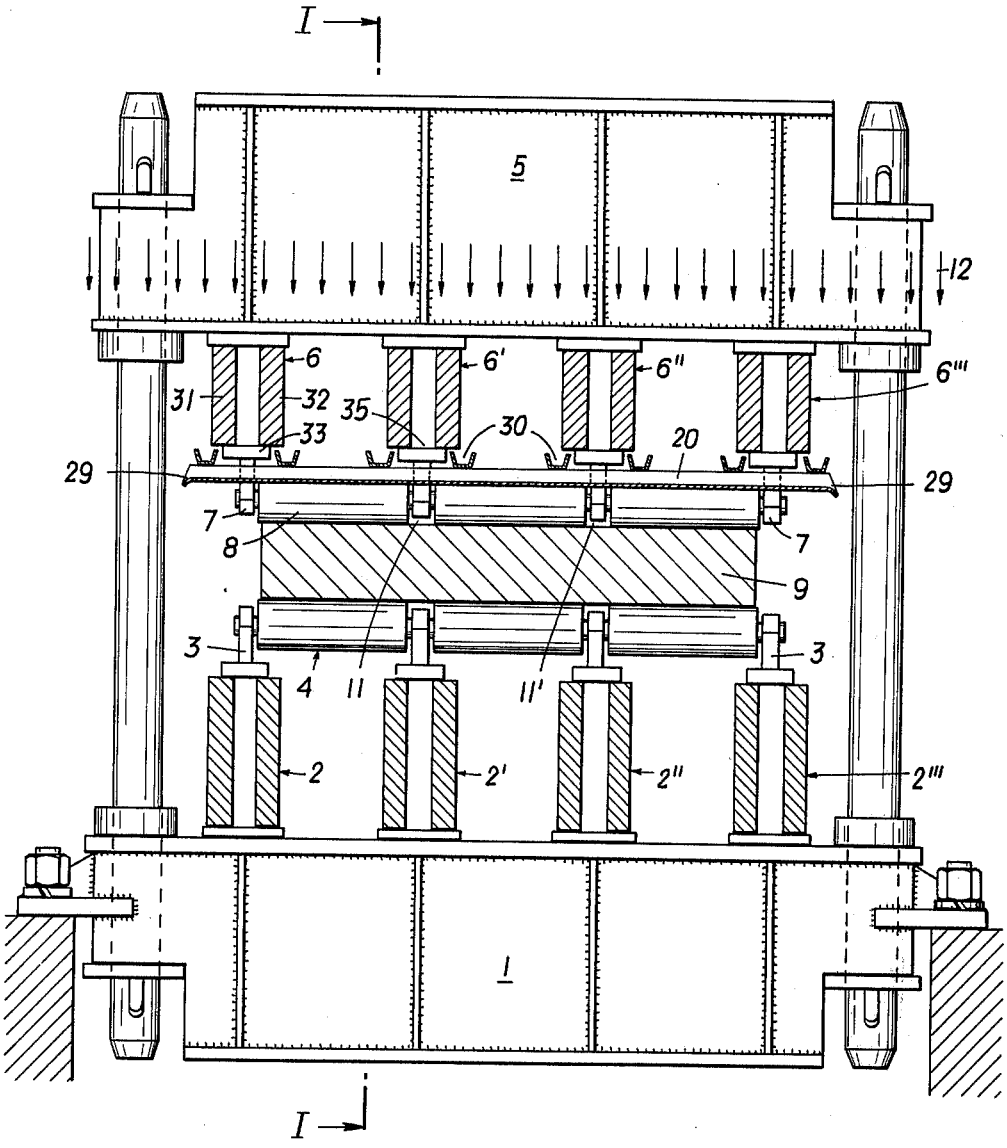
FIG. 2 is a section along line II—II of FIG. 1.
Figure 3:
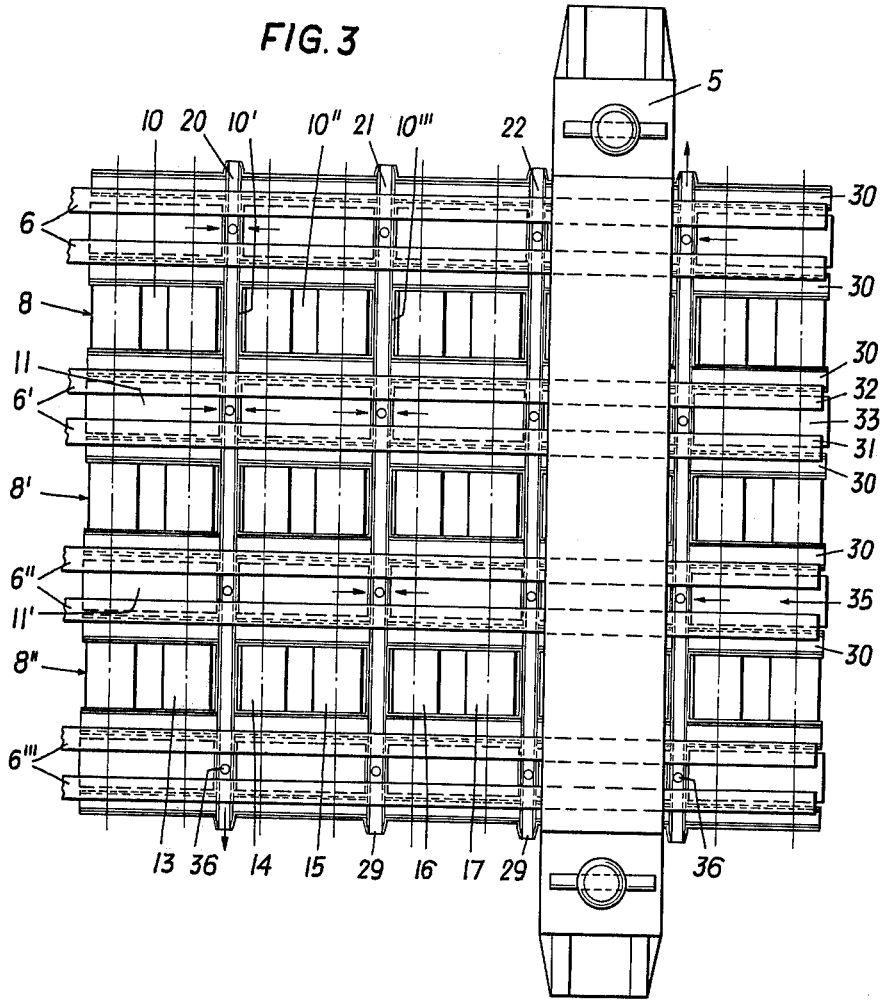
FIG. 3 represents a plan view of the plant according to FIGS. 1 and 2.

On the lower crosshead 1 (FIGS. 1 and 2) four carriers 2'', and 2', 2'', 2''' are arranged at a distance from each other. The carriers support bearing blocks 3 for the three-component rollers 4 of the lower roller path. Each bearing block receives two rollers. To the upper crosshead 5 four longitudinal carriers 6'', and 6', 6'', 6''' are secured. They carry the bearing blocks 7 for the rollers 8 of the upper roller path, which rollers as well consist of three components. Also in this case each bearing block receives two rollers. The still glowing slab is denoted with 9 and is drawn between the upper and the lower roller path. As can be seen from the plan view according to FIG. 3, free spaces, e.g. 10, 10', 10'' and 10''', are present in the casting direction between the individual rollers 8, which are arranged to follow one another. Also in a direction transverse to the casting direction free spaces 11 and 11' in FIG. 2 are present between the roller components 8, 8' and 8''. In the view of FIG. 3 from above these spaces the strand surface appears through said spaces in fields crossing each other. In the upper part of the crosshead 5 a tube system, not illustrated in detail, for the cooling water is provided. The cooling water falls onto the plant from above in the form of a spray according to the schematically drawn arrows 12. The spray should be as finely distributed as possible. According to the invention, above and between the rollers, e.g. rollers 13, 14, 15, 16, 17 and 18, which are arranged to follow one another in the casting direction and the transporting direction, namely, transverse channels are arranged, namely, as can be seen from FIG. 3, at least between every second space, e.g. 13–14, 15–16 and 17–18. Said transverse channels are denoted with 20, 21, 22 etc. They are secured to the bearing construction of the rollers 13, 14 etc., for instance by means of a securing rail, and are provided with outlets 29 at either side. The base plate 33 of the bearing blocks is welded to the carriers 6, which are comprised of two crosspieces 31 and 32. Thus channels 35 are formed, i.e. in the example according to FIG. 3 four channels 35 are formed extending in the casting direction. The transverse channels 20 and the longitudinal channels 35 are interconnected by means of passages 36, so that the surplus cooling water may flow through the channels in the direction of the arrows according to FIG. 3 and may finally flow out laterally through the outlets 29. Below each longitudinal carrier 6 at either side thereof narrow longitudinal channels 30 may be additionally provided. These longitudinal channels are supported by the transverse channels 20 and drain off the water flowing laterally along the longitudinal carriers.

Figure 4:
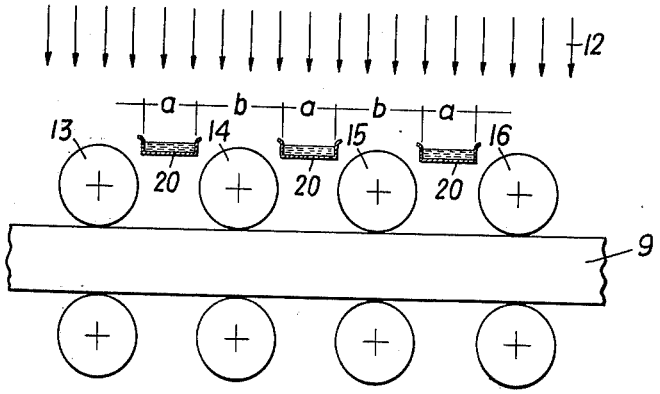
FIG. 4 shows a schematic illustration of a side view of a modified embodiment.

According to a preferred embodiment of the invention the transverse channels 20 are arranged not only above every second space between the rollers, but also above each space, as is illustrated schematically in FIG. 4. In this case the channels 20 are provided both between the rollers 13, 14, and between the rollers 14, 15 and 15, 16. The width *a* of the transverse channels adds up with the diameter *b* of the rollers in such a way that seen from above no free space is present between the machine parts. The low quantity of cooling water, which in this embodiment flows from the rollers 14 onto the strand surface 9, evaporates so that a perfectly regular cooling is achieved.

What I claim is:

1. Apparatus for cooling a continuously cast strand, for example a slab, by means of cooling water in a tertiary cooling zone of a continuous casting plant, the strand being bent from a vertical direction into a horizontal direction in said tertiary cooling zone, said tertiary cooling zone including a lower guiding-roller path and an upper guiding-roller path comprised of rollers for guiding, supporting and transporting the strand, and a plurality of associated machine parts, said rollers being arranged to follow one another, each roller being comprised of several cylindrical components on a common shift wherein the improvement comprises:

cooling water spray nozzles arranged above the upper guiding-roller path over the entire width of the strand, said nozzles causing the cooling water to fall onto the machine parts and rollers of the upper guiding roller path from above in a finely distributed spray;

transverse channels running transversely to the casting direction of the strand and being arranged higher than the rollers of the upper guiding-roller path in the area of the uncovered spaces above the strand between the machine parts and the rollers, but lower than the spray nozzles, said channels draining off the surplus cooling water in the area of the uncovered spaces; and longitudinal channels running in the casting direction of the strand and being located at the spaces between the several components of the rollers, said longitudinal channels forming a network with said transverse channels and said longitudinal channels and said transverse channels being interconnected at their points of intersection.

2. A continuous casting plant as set forth in claim 1, wherein the channels running transversely in relation to the casting direction of the strand are provided with lateral outlets.

3. A continuous casting plant as set forth in claim 1, wherein the rollers of the upper guiding-roller path are secured to longitudinal carriers comprising two crosspieces and a base plate so as to form the longitudinal channels and wherein the channels running transversely to the casting direction of the strand are fastened on a bearing construction of said rollers.

4. A continuous casting plant as set forth in claim 3, additionally comprising narrow longitudinal channels arranged at either side of each longitudinal carrier, said longitudinal channels being supported by the channels running transversely to the casting direction of the strand.

* * * * *

UNITED STATES PATENT AND TRADEMARK OFFICE

CERTIFICATE OF CORRECTION

PATENT NO. : 3,983,925

DATED : October 5, 1976

INVENTOR(S) : Wilhelm Dutzler

It is certified that error appears in the above-identified patent and that said Letters Patent are hereby corrected as shown below:

First page, Item [30], "10548/73" should read --10584/73--;

Column 1, line 53, insert --,-- after "preventing";

Column 2, line 48, "6'', and 6', 6'', 6''''" should read --6, 6', 6'' and 6'''--;

Column 3, line 4, delete "namely,";

line 5, delete "namely,".

Signed and Sealed this

Fifteenth Day of February 1977

[SEAL]

*Attest:*

RUTH C. MASON
*Attesting Officer*

C. MARSHALL DANN
*Commissioner of Patents and Trademarks*